US006980100B1

(12) United States Patent
Hammond

(10) Patent No.: US 6,980,100 B1
(45) Date of Patent: Dec. 27, 2005

(54) SECURITY DEVICE AND ALARM SYSTEM

(76) Inventor: Dorothy L. Hammond, P.O. Box 21295, Wichita, KS (US) 67208

( * ) Notice: Subject to any disclaimer, the term of this patent is extended or adjusted under 35 U.S.C. 154(b) by 0 days.

(21) Appl. No.: 10/915,863

(22) Filed: Aug. 11, 2004

(51) Int. Cl.[7] ..... G08B 26/00
(52) U.S. Cl. ..... 340/505; 340/572.1; 340/10.1
(58) Field of Search ..... 340/505, 568.1, 340/568.8, 571, 572.1, 10.1, 572.4, 10.32

(56) References Cited

U.S. PATENT DOCUMENTS

| | | | | |
|---|---|---|---|---|
| 4,158,197 | A | 6/1979 | Takagaki | |
| 4,520,351 | A | 5/1985 | Altman et al. | |
| 4,584,571 | A | 4/1986 | Smit et al. | |
| 4,692,749 | A | 9/1987 | Bussing, Jr. | |
| 5,881,021 | A | 3/1999 | Pirie et al. | |
| 5,923,253 | A | 7/1999 | Anastasiou | |
| 5,963,131 | A | 10/1999 | D'Angelo et al. | |
| 6,147,611 | A | 11/2000 | Otero | |
| 6,172,607 | B1 | 1/2001 | McDonald | |
| 6,570,487 | B1 * | 5/2003 | Steeves | 340/5.2 |
| 6,577,238 | B1 * | 6/2003 | Whitesmith et al. | 340/572.1 |
| 6,609,656 | B1 * | 8/2003 | Elledge | 235/382 |
| 6,719,202 | B1 * | 4/2004 | Kawai et al. | 235/462.13 |
| 6,737,973 | B2 * | 5/2004 | Jesme | 340/572.1 |

* cited by examiner

*Primary Examiner*—Toan N. Pham
(74) *Attorney, Agent, or Firm*—Dale J. Ream

(57) ABSTRACT

A security device and alarm system includes a reader preferably concealed in a fabric article, at least one tag, and an alarm unit. The reader includes a reader transmitter, reader receiver, CPU, power source, and power switch. The tag includes a tag transmitter and a tag receiver. If using active RFID tags, each tag includes a power source. The alarm unit includes an alarm receiver, alarm, and power source. If the reader receiver does not receive an appropriate reply from the tag transmitter after the reader transmitter sends a query to the tag receiver, or if the reader was deactivated, the reader transmitter sends an alarm signal to the alarm unit. Upon the alarm receiver's receipt of the alarm signal, the alarm is energized. If using multiple active RFID tags, the CPU checks for each through tag transmission identifiers, and the alarm identifies the missing tag through unique alarm signals.

6 Claims, 8 Drawing Sheets

SECURITY DEVICE AND ALARM SYSTEM

BACKGROUND OF THE INVENTION

This invention relates generally to a security device. In particular, the present invention relates to an anti-theft security device and alarm system.

Security devices are a part of doing business today. The low cost and obvious benefit of anti-theft measures make them used even on objects of small value in department and retail stores. However, rare objects and collectibles are often found unprotected in today's marketplace. This is partly the result of the decentralized nature of the antique business, trade shows, festivals, and similarly operated businesses in which there are many operators of independent booths in a single area. An anti-theft measure addressing the needs of decentralized merchants would be a welcome addition to their professions. Specifically, an alarm system is needed that provides warning when a dealer's property is moved.

Many stores utilize AM (acousto-magnetic) tags. Wide entrances can be covered, and the tags themselves are inexpensive. A transmitter is set near the area to be monitored (usually on one side of the store's door) and sends out intermittent pulses of radio waves. The material the tag is made of actually expands and contracts in size in the presence of this radio field. If the transmitter is operating at the correct frequency, the tag resonates like a tuning fork and produces a radiated signal that continues in between the pulses of radio waves. A receiver set to correspond to the transmitter (usually on the opposite side of the store's door, so that everything must pass between the transmitter and receiver when leaving) listens for this vibration to sense a tag. This system cannot distinguish multiple tags, however, and is poorly suited for monitoring multiple booths or areas without tightly controlled exits.

The most commonly used anti-theft systems in stores are swept-RF systems, mostly due to their extremely low cost. In these systems, a tag is little more than a simple transmitter circuit and a flexible aluminum antennae printed on a paper backing. When an item is purchased, a high-energy burst of radio energy is delivered in close proximity to the tag. This burns out the circuitry and deactivates the tag. Receivers are positioned at the stores' exits to detect active tags. However, like the AM systems described above, swept-RF is unable to distinguish multiple tags. It also suffers from being poorly suited for monitoring multiple booths or areas without tightly controlled exits.

The fastest rising trend in security products is RFID (Radio Frequency Identification). Essentially, a stationary reader sends out a radio signal of a particular frequency. The tag responds to this signal by "replying" in a way that alerts the reader that a tag has just entered its range. This information can then be used to draw conclusions about the location of the tagged object. If a theft is suspected, an alarm can be triggered. In passive RFID systems, the tag does not require a battery. Instead, the energy of the reader signal provides the energy necessary to reply. The circuitry required is exceedingly small—not much bigger than a grain of rice. These devices can also be very unobtrusive and have lengthy life-spans. The largest disadvantage of passive systems is that the reader must provide a powerful transmission in order to power the tag. This results in large power requirements and limits the signal range. Generally the tag must be within a few feet of the reader to be "seen".

Active RFID systems are powered by a battery onboard the tag. When the tag detects the reader signal, it transmits a reply. Some active systems have a range of hundreds of feet, but more importantly multiple tags can be identified simultaneously. The tag can also respond independently of the reader, such as activating if an attempt is made to disable it. Both passive and active RFID systems in the current state of the art rely on detecting the presence of a tag near an exit to activate an alarm.

Various proposals for other theft alarm devices are found in the art. U.S. Pat. No. 4,584,571 discloses attaching a permanent magnetic body to a valuable article that is placed in a bag. The bag includes circuitry that sets off an alarm when the magnet is missing unless manually overridden.

U.S. Pat. No. 5,963,131 discloses using a motion sensor in combination with a proximity sensor to guard valuables and reduce incidences of false alarms. A theft detector unit is integrated into a laptop, and a control unit is carried by the user to maintain two-way communication with the laptop.

U.S. Pat. No. 6,172,607 discloses an alarm that is attached to an object and manually activated. When the object is thereafter moved, an alarm sounds until disarmed by entering a security code or the internal power source is exhausted. Thus, the alarm detects its own movement, and no corresponding device is used.

While assumably effective for their intended purposes, none of the above proposals provide an anti-theft alarm system that addresses the needs of decentralized merchants. Therefore, it is desirable to have a security device and alarm system that is unobtrusive, can be used in a variety of settings, is able to monitor and distinguish between multiple objects, alerts the merchant when the device is turned off, and is inexpensive.

SUMMARY OF THE INVENTION

A security device and alarm system according to the present invention includes a reader, at least one security tag, and an alarm unit. The reader includes a reader transmitter, a reader receiver, a CPU, a reader power source, and a power switch. The security tag is remote from the reader and includes a tag transmitter electrically connected to a tag receiver. If active RFID tags are used, each tag also includes a power source. The alarm unit is remote from the reader and the tag and includes an alarm receiver and an alarm electrically connected to an alarm power source.

In use, an inspection loop is established wherein the reader transmitter sends a query signal to the tag, the tag receiver receives the query signal, the tag transmitter sends a reply signal, the reader receiver receives the reply signal, and the reader CPU checks for the appropriate reply signal and for power failure of the reader. If an appropriate reply signal is not received by the reader receiver or if the CPU has been turned off, the reader transmitter sends an alarm signal to the alarm unit. Upon receipt of an alarm signal by the alarm receiver, the alarm is energized. If multiple active RFID tags are used, the reader CPU checks for the presence of each active RFID tag through the use of tag transmission identifiers. Further, unique alarm signals are used to identify the missing active RFID tag, and the alarm includes means to identify each active RFID tag individually. The reader is preferably concealed in a fabric article, though other arrangements are of course possible.

Therefore, a general object of this invention is to provide a security device and alarm system that takes into account the decentralized nature of many businesses.

Another object of this invention is to provide a security device and alarm system, as aforesaid, that is unobtrusive.

Still another object of this invention is to provide a security device and alarm system, as aforesaid, that can be used in a variety of conditions, such as inside, outside, in separate booth arrangements, in large galleries, etc.

Yet another object of this invention is to provide a security device and alarm system, as aforesaid, that is able to monitor and distinguish between multiple objects.

A further object of this invention is to provide a security device and alarm system, as aforesaid, that alerts the merchant when the device is turned off.

A still further object of this invention is to provide a security device and alarm system, as aforesaid, that is inexpensive.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
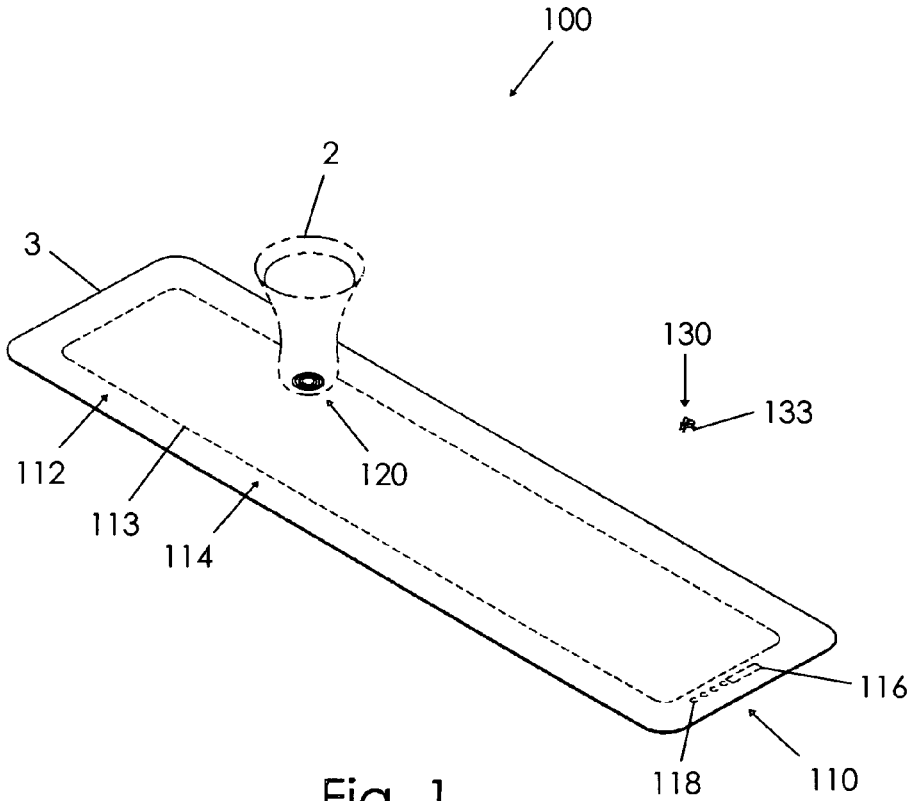
FIG. 1 is a perspective view of a security device and alarm system according to one embodiment of the present invention with the reader being positioned in a fabric article, the tag being incorporated into a vase, and the alarm unit.

A security device and alarm system according to the present invention will now be described in detail with reference to FIGS. 1 through 3 of the accompanying drawings. More particularly, a security device and alarm system 100 includes a reader 110, a security tag 120, and an alarm unit 130.

Figure 2:
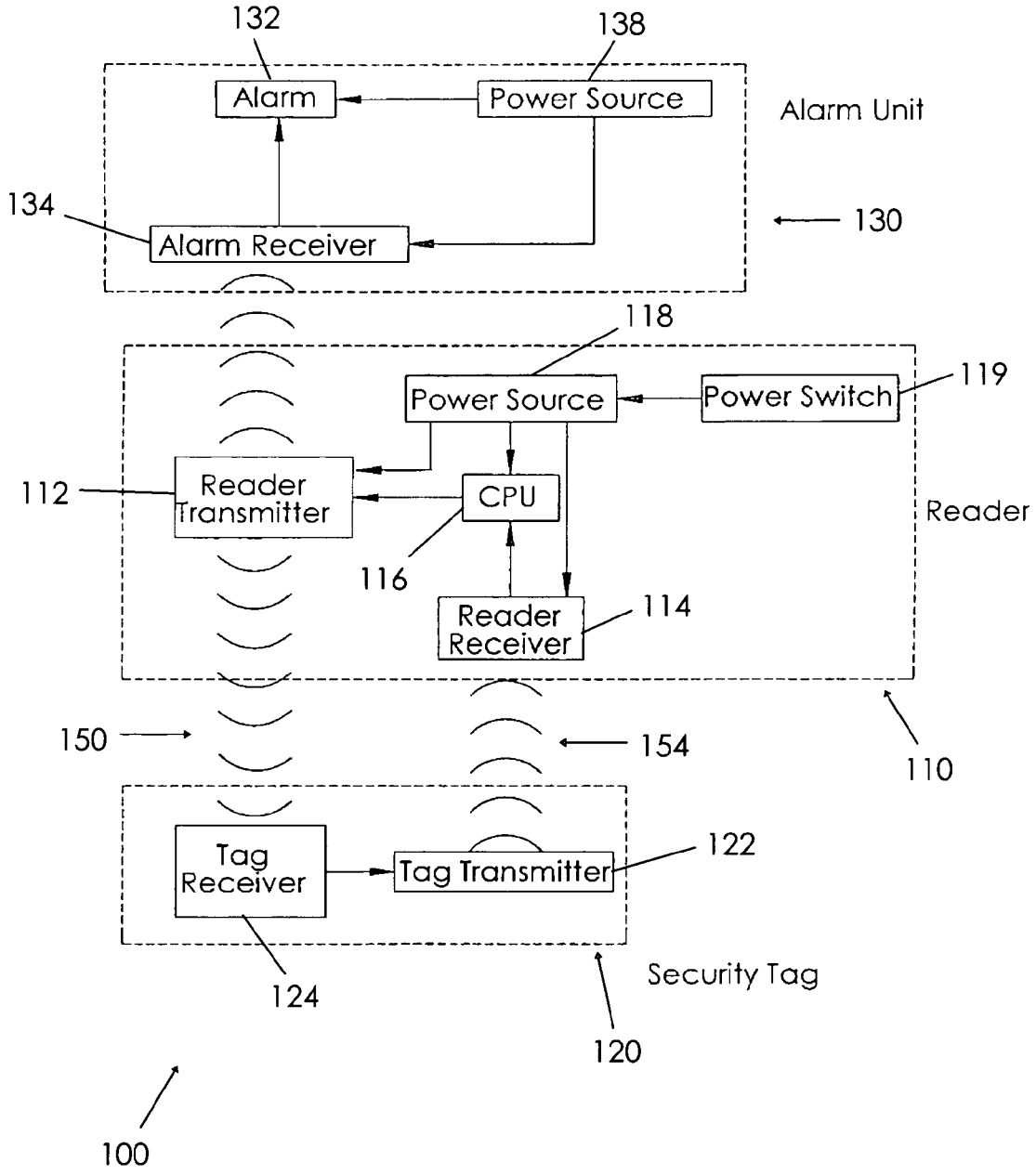
FIG. 2 is a block diagram showing the components of the security device and alarm system as in FIG. 1.
Figure 3:
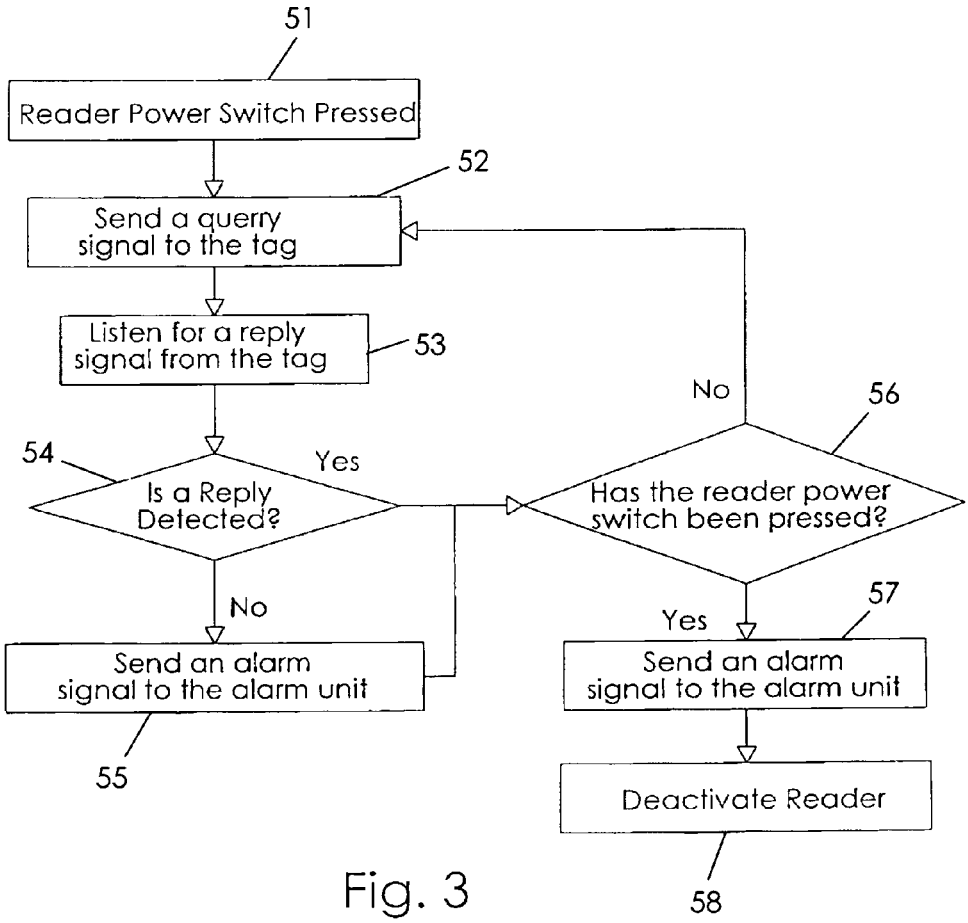
FIG. 3 is a flow chart explaining the operation of the security device and alarm system as in FIG. 1.

The reader 110 includes a reader transmitter 112, a reader receiver 114, a CPU 116, a reader power source 118, and a power switch 119 electrically connected as shown in FIG. 2. The reader transmitter 112 is capable of transmitting query signals 150 and alarm signals 152, and the reader receiver 114 is capable of receiving reply signals 154. The reader transmitter 112 and the reader receiver 114 preferably utilize RFID (Radio Frequency Identification) technology, making the reader 110 a RFID reader 110. A wire loop antenna 113 preferably functions as both the reader transmitter 112 and the reader receiver 114, though other transmitters and receivers may of course be used. It is also understood that other technologies may be suitable besides RFID, such as AM (acousto-magnetic) or swept-RF technology.

The tag 120 is remote from the reader 110 and includes a tag transmitter 122 electrically connected to a tag receiver 124 (FIG. 2). The tag transmitter 122 is used to transmit reply signals 154, and the tag receiver 124 is used to receive query signals 150. Here, the tag 120 is a passive RFID tag and does not require a battery power source. Instead, energy from signals received by the tag receiver 124 is used to power the tag transmitter 122. Whenever the tag receiver 124 receives a query signal 150, the energy from the query signal 150 powers the tag transmitter 122, and the tag transmitter 122 transmits a reply signal 154.

Figure 4:
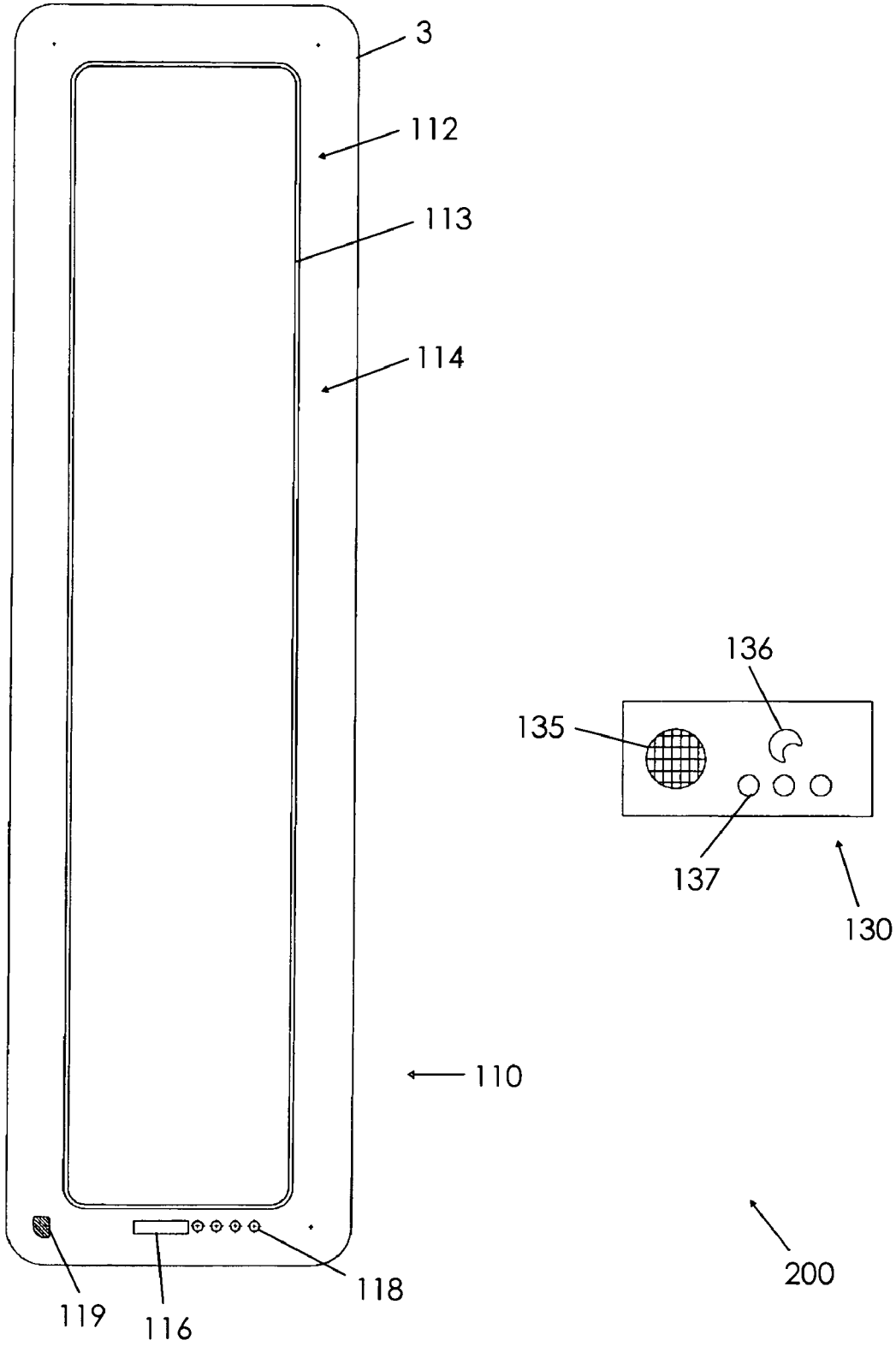
FIG. 4 is a top view of a reader according to another embodiment of the present invention being positioned in a fabric article, but shown without the fabric, and an alarm unit according to another embodiment of the present invention, but shown without tag devices.

The alarm unit 130 is remote from the reader 110 and the tag 120 and includes an alarm 132, an alarm receiver 134, and an alarm power source 138 electrically connected as shown in FIG. 2. The alarm receiver 134 is used for receiving alarm signals 152, and the alarm 132 is used to notify a user of the alarm signal 152. Whenever the alarm receiver 134 receives an alarm signal 152, the alarm power source 138 energizes the alarm 132. The alarm 132 may incorporate various alarming devices, such as a piezoelectric buzzer 135, a vibrator 136, or a visual alarm 137, or the like (FIG. 4). The alarm unit 130 may be very small, allowing the alarm unit 130 to be shaped like jewelry (such as the bumblebee broach alarm unit 133 seen in FIG. 1) or to be placed easily in a pocket. Conversely, the alarm unit 130 may be larger to incorporate a piezoelectric buzzer 135, a vibrator 136, and a visual alarm 137, as well as other desired alarming devices (FIG. 4). Ideally, the alarm 132 unobtrusively informs the user that an object has been moved from the range of the security device and alarm system 100.

In use, the reader 110 is preferably positioned in a fabric article for concealing the presence of the reader 110, such as a table with a fabric top 3 (FIG. 1), a tablecloth, or rug. While most large retailers with tightly controlled exits opt to make their security devices clearly visible, it may be beneficial to the decentralized merchant to conceal the presence of the security device and alarm system 100. Concealment that a security system exists may in fact reduce the likelihood that someone will attempt to bypass the security device and alarm system 100 while unattended. The tag 120 is attached to an item of value that the user wishes to protect by adhesives, clips, or other attachment means. The tag 120 is shown attached to a vase 2 in FIG. 1. The user then monitors the alarm unit 130. The processing steps of the logic performed by the reader 110 are shown in the flowchart of FIG. 3.

In process step S1, the reader power switch 119 is pressed, turning the reader 110 on. The process then proceeds to step S2, where the reader transmitter 112 sends a query signal 150 to the tag receiver 124. The process then proceeds to step S3, where the reader receiver 114 attempts to receive a reply signal 154 from the tag transmitter 122. The process then proceeds to step S4.

In process step S4, the reader CPU 116 determines whether the reader receiver 114 received a reply signal 154 from the tag transmitter 122. If so, the process is directed to step S6. If not, the process is directed to step S5.

In process step S5, the reader transmitter 112 sends an alarm signal 152 to the alarm receiver 134, and the process proceeds to step S6. It should be appreciated that the reader 110 is using an object's absence to notify a user of possible theft, unlike traditional anti-theft devices used by large retailers that use an object's presence near an exit to notify of possible theft.

In process step S6, the reader CPU 116 determines whether the reader power switch 119 has been pressed to turn the reader 110 off. If not, the process proceeds to step S2, forming an inspection loop. If so, the process is directed to step S7.

In process step S7, the reader transmitter 112 sends an alarm signal 152 to the alarm receiver 134, and the process proceeds to step S8.

In process step S8, the reader 110 deactivates (turns off). It is obvious, then, that the reader 110 cannot be deactivated without the user being warned.

Figure 5:
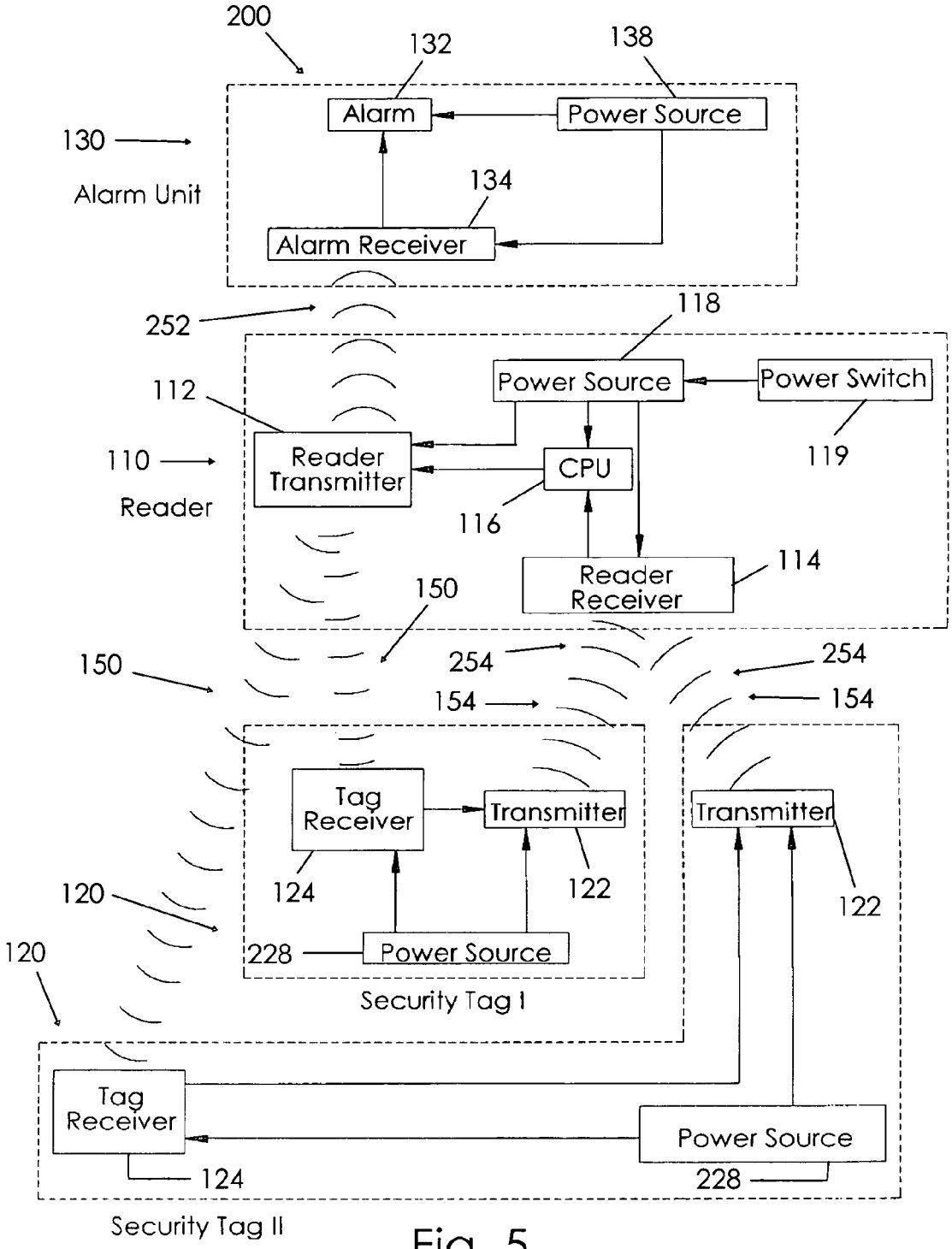
FIG. 5 is a block diagram showing the components of the security device and alarm system as in FIG. 4.
Figure 6:
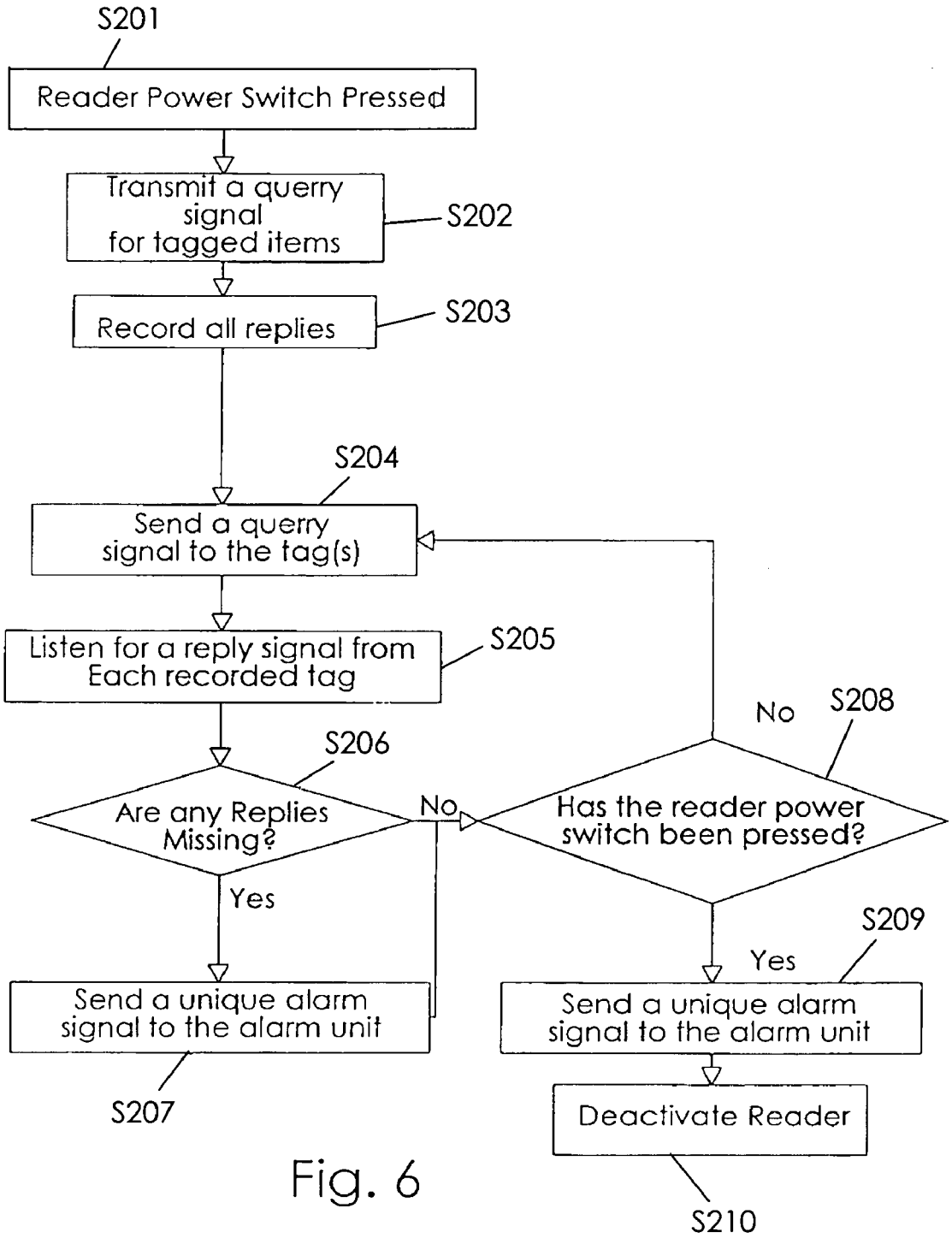
FIG. 6 is a flow chart explaining the operation of the security device and alarm system as in FIG. 4.

A security device and alarm system 200 according to another embodiment of the present invention is shown in FIGS. 4 through 6 and includes a construction substantially similar to the construction previously described except as specifically noted below. More particularly, the security device and alarm system 200 according to this embodiment is an active RFID system.

Each tag 120 of a plurality of tags 120 is an active RFID tag that includes a tag transmitter 122, a tag receiver 124, and a power source 228 (FIG. 5). Each tag transmitter 122 has a predetermined tag transmission identifier 254 different from a predetermined tag transmission identifier 254 of any other tag transmitter 122 (FIG. 5). Whenever the tag receiver 124 receives a query signal 150, the power source 228 powers the tag transmitter 122, and the tag transmitter 122 transmits a reply signal 154 that includes a corresponding tag transmission identifier 254. The tag transmission identifier 254 is preferably a unique modulation or frequency, though other identifiers are of course possible.

The reader transmitter 112 and the reader receiver 114 utilize active RFID technology, making the reader 110 an active RFID reader 110 (FIG. 5). The reader CPU 116 has means for recognizing each tag transmission identifier 254 and associating each tag transmission identifier 254 with a corresponding active RFID tag 120. The reader CPU 116 also has means for determining whether an appropriate reply signal 154 is received by the reader receiver 114 after the reader transmitter 112 transmits a corresponding query signal 150. The reader transmitter 112 includes means for transmitting a plurality of unique alarm signals 252, and each unique alarm signal 252 is associated with a respective active RFID tag 120. Transmission of the unique alarm signals 252 by the reader transmitter 112 is actuated by the reader CPU 116 if the appropriate reply signals 154 are not received by the reader receiver 114 after the reader transmitter 112 transmits a corresponding query signal 150.

The alarm unit 130 includes means for indicating which active RFID tag 120 is associated with each unique alarm signal 252 and, when the alarm receiver 134 receives a unique alarm signal 252, the alarm 132 indicates the associated active RFID tag 120. This may be done through a plurality of visual alarms 137, different behaviors of the piezoelectric buzzer 135 or the vibrator 136, or a combination of the various alarming devices.

The processing steps of the logic performed by the reader 110 are shown in the flowchart of FIG. 6. In process step S201, the reader power switch 119 is pressed, turning the reader 110 on. The process then proceeds to step S202, where the reader transmitter 112 sends a query signal 150 to the tag receivers 124. The process then proceeds to step S203, where the reader receiver 114 receives all reply signals 154 and the reader CPU 116 records the corresponding tag transmission identifiers 254. The process then proceeds to step S204.

In process step S204, the reader transmitter 112 sends a query signal 150 to the tag receivers 124. The process then proceeds to step S205, where the reader receiver 114 receives all reply signals 154. The process then proceeds to step S206.

In process step S206, the reader CPU compares each tag transmission identifier 254 received in step S205 to the tag transmission identifiers 254 recorded in step S203 and determines if any replies are missing. If so, the process is directed to step S207. If not, the process is directed to step S208.

In process step S207, the reader transmitter 112 sends a unique alarm signal 252 corresponding to the missing active RFID tag 120 to the alarm receiver 134, and the process proceeds to step S208.

In process step S208, the reader CPU 116 determines whether the reader power switch 119 has been pressed to turn the reader 110 off. If not, the process proceeds to step S204, forming an inspection loop. If so, the process is directed to step S209.

In process step S209, the reader transmitter 112 sends a unique alarm signal 252 corresponding to the power failure to the alarm receiver 134, and the process proceeds to step S210.

In process step S210, the reader 110 deactivates (turns off). It is obvious, then, that the reader 110 cannot be deactivated without the user being warned and that the user receives notice of which RFID tag 120 is missing, if any.

Figure 7:
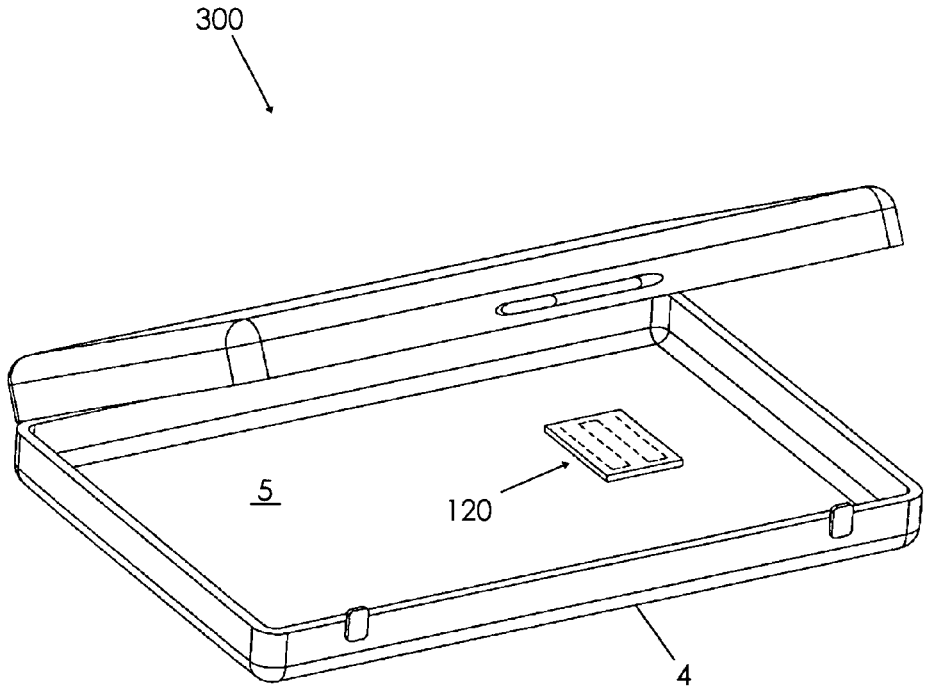
FIG. 7 is a perspective view of a security device and alarm system according to still another embodiment of the present invention, but shown without an alarm unit.
Figure 8A:
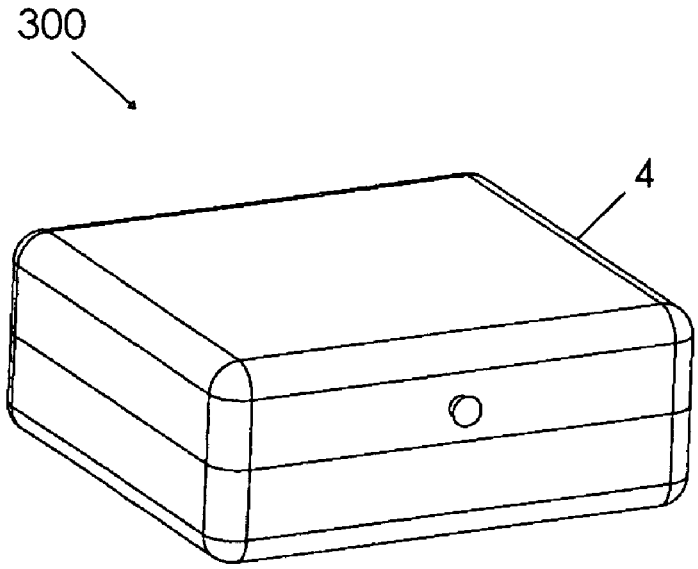
FIG. 8*a* is a perspective view of the security device and alarm system as in FIG. 7.
Figure 8B:
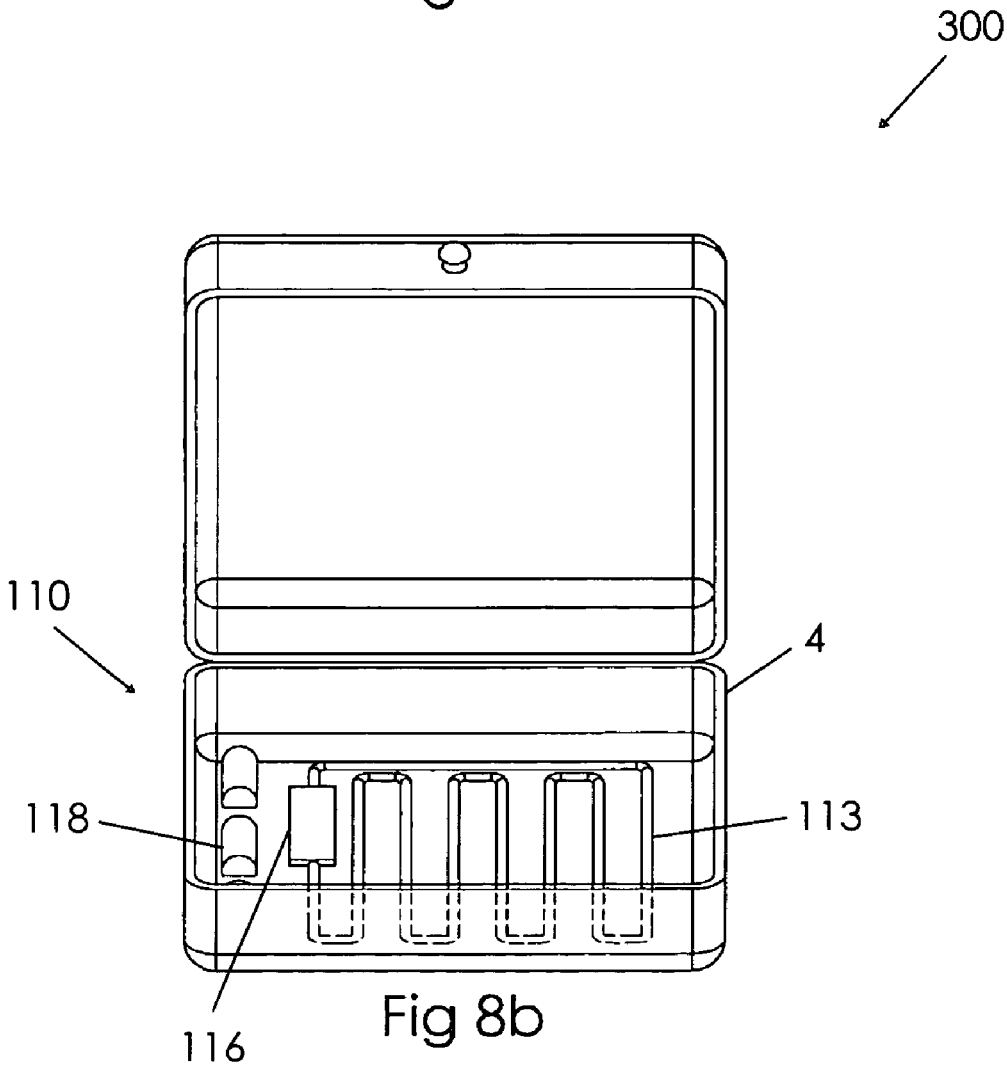
FIG. 8*b* is a perspective view of the security device and alarm system as in FIG. 7, but shown without tag devices or the case lining.

A security device and alarm system 300 according to still another embodiment of the present invention is shown in FIGS. 7 through 8*b* and includes a construction substantially similar to the construction previously described except as specifically noted below. More particularly, the reader 110 of the security device and alarm system 300 according to this embodiment is positioned in an ornamental case 4 for concealing the presence of the reader 110. FIG. 8*b* is shown without the case lining 5 to better demonstrate the security device and alarm system 300.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An alarm system, comprising:

an RFID reader having means for transmitting and receiving query and reply signals, respectively, said RFID reader including means for transmitting a plurality of unique alarm signals;

a plurality of RFID tags remote from said RFID reader, each said RFID tag including a respective tag receiver for receiving said query signals from said RIFD reader and a respective tag transmitter for transmitting said reply signals, each said tag transmitter having a predetermined tag transmission identifier different from a predetermined tag transmission identifier of any other said tag transmitter, each said RFID tag including means for including a respective tag transmission identifier in a respective reply signal, each said RFID tag being associated with a respective unique alarm signal;

wherein said RFID reader includes means for recognizing a respective tag transmission identifier included in a received reply signal and for associating said recognized tag transmission identifier with a corresponding RFID tag and a corresponding unique alarm signal; and an alarm unit remote from said RFID reader and said plurality of RIFD tags having an alarm receiver for receiving said unique alarm signals transmitted by said RFID reader, said alarm unit including means for energizing said alarm according to said corresponding unique alarm signal received by said alarm receiver, whereby to indicate said corresponding RFID tag.

2. The alarm system as in claim 1 wherein:

said means in said RFID reader for transmitting said query signals and said means in said RFID reader for transmitting said unique alarm signals is a reader transmitter;

said means in said RFID reader for receiving said reply signals is a reader receiver; and said RFID reader further includes a CPU having means for determining whether an appropriate reply signal is received by said reader receiver after said reader transmitter transmits a corresponding query signal, said CPU further including means for actuating transmission of said alarm signal if said appropriate reply signal is not received by said reader receiver after said reader transmitter transmits a said corresponding query signal.

3. The alarm system as in claim 2 wherein said CPU includes means for actuating transmission of a said unique alarm signal when said RFID reader has been deactivated.

4. The alarm system as in claim 1 further comprising means in said RFID reader for actuating transmission of a said unique alarm signal when said RFID reader has been deactivated.

5. The alarm system as in claim 1 wherein each said RFID tag is an active RFID tag having a power source for powering said respective tag transmitter.

6. The alarm system as in claim 1 wherein said RFID reader is positioned in a fabric article for concealing the presence of said RFID reader.

* * * * *